US010524981B2

(12) United States Patent
Giraud

(10) Patent No.: US 10,524,981 B2
(45) Date of Patent: Jan. 7, 2020

(54) CAP AND CONTAINER ASSEMBLY FOR A DOSAGE PRODUCT

(71) Applicant: CSP Technologies, Auburn, AL (US)

(72) Inventor: Jean-Pierre Giraud, Auburn, AL (US)

(73) Assignee: CSP Technologies, Inc., Auburn, AL (US)

( * ) Notice: Subject to any disclaimer, the term of this patent is extended or adjusted under 35 U.S.C. 154(b) by 0 days.

(21) Appl. No.: 15/178,792

(22) Filed: Jun. 10, 2016

(65) Prior Publication Data

US 2016/0279030 A1 Sep. 29, 2016

Related U.S. Application Data

(63) Continuation of application No. 14/000,536, filed as application No. PCT/US2012/020164 on Jan. 4, 2012, now abandoned.

(60) Provisional application No. 61/450,386, filed on Mar. 8, 2011.

(51) Int. Cl.

| | |
|---|---|
| ***B65D 25/08*** | (2006.01) |
| ***A61J 1/20*** | (2006.01) |
| ***B65D 51/30*** | (2006.01) |
| ***B65D 51/28*** | (2006.01) |
| ***A61J 1/18*** | (2006.01) |
| ***B65D 43/02*** | (2006.01) |
| *A61J 1/14* | (2006.01) |

(52) U.S. Cl.

CPC ..... *A61J 1/201* (2015.05); *A61J 1/18* (2013.01); *B65D 43/0235* (2013.01); *B65D 51/2835* (2013.01); *B65D 51/30* (2013.01); *A61J 1/1418* (2015.05)

(58) Field of Classification Search

CPC ... A61J 3/074; A61J 1/201; A61J 1/18; B65D 81/3211; B65D 81/32; B65D 81/3222; B65D 51/2835; B65D 43/0235; B65D 51/30; B65D 25/08

USPC ..... 206/222, 219, 220, 221; 222/80, 81, 222/83.5, 83; 53/468, 473, 409, 420, 467

See application file for complete search history.

(56) References Cited

U.S. PATENT DOCUMENTS

| | | | | |
|---|---|---|---|---|
| 8,672,154 | B2 * | 3/2014 | Seelhofer | B65D 51/2821 206/222 |
| 2007/0084735 | A1 * | 4/2007 | Lancesseur | B65D 43/164 206/204 |
| 2010/0236952 | A1 * | 9/2010 | Masterson | B65D 51/2835 206/222 |

* cited by examiner

*Primary Examiner* — Rafael A Ortiz

(74) *Attorney, Agent, or Firm* — Mark T. Vogelbacker; Eckert Seamans Cherin & Mellott, LLC

(57) ABSTRACT

A dosage dispensing cap and container assembly and method of use are disclosed. The assembly includes a container defining an opening that leads to an interior space. A cap is removably affixed over the opening and defines a channel that leads to the interior space. The cap includes a puncturing structure positioned at a bottom region of the channel. A plunger is slidably disposed within the channel and includes a sleeve portion and a dosage product housed within the sleeve portion. The plunger slides within the channel between a first position in which the plunger is located in an upper region of the channel, and a second position in which the plunger is located in a lower region of the channel and the dosage product contacts the puncturing structure.

12 Claims, 7 Drawing Sheets

CAP AND CONTAINER ASSEMBLY FOR A DOSAGE PRODUCT

FIELD OF INVENTION

The invention pertains to a cap and container assembly for mixing and/or storage of a dosage material and carrier.

BACKGROUND

Many consumer products are sold in forms intended to be mixed with a carrier to produce an end product. Such products (hereinafter referred to as "dosage products") may be, for example, in solid or concentrated liquid form. Solid dosage products can be provided in a variety of forms including powders, granules, pucks, tablets and capsules. The carrier is often in liquid form but may take on a solid form as well. Dosage products have the advantage of delaying interaction between the dosage product and the carrier, which can extend shelf life. Such products may include consumables and nonconsumables. Examples of consumable dosage products include food or beverage mixes, nutritional supplements, and pharmaceuticals.

Dosage products may be sold as two component systems including the dosage product and the carrier, or alternatively the dosage product may be sold alone where, for example, the carrier is a readily available substance, such as water. Two component systems have the advantage of providing all necessary ingredients in a single system or package, whereas dosage product only systems have the advantage of compactness and ease of transport.

Typical steps for use of a dosage product include placing the carrier in a suitable receptacle, unpackaging the dosage product and adding it to the receptacle, and mixing the dosage product with the carrier by agitating or stirring with a utensil. This process involves numerous steps and often a suitable receptacle is not available. In dosage product only systems, a suitable carrier may not always be available. Additionally, many dosage product systems cannot be mixed in the same receptacle as that which the carrier was initially stored in. A need exists for a dosage product system including all necessary components for preparation, as well as a suitable receptacle for storage of the carrier, mixing of the dosage product and carrier, and storage of the mixed end product.

SUMMARY

The present invention is directed to a dosage dispensing cap and container assembly. The assembly includes a container defining an opening that leads to an interior space. A cap is removably affixed over the opening and defines a channel that leads to the interior space. The cap includes a puncturing structure positioned at a bottom region of the channel. A plunger is slidably disposed within the channel and includes a sleeve portion and a dosage product housed within the sleeve portion. The plunger slides within the channel between a first position in which the plunger is located in an upper region of the channel, and a second position in which the plunger is located in a lower region of the channel and the dosage product contacts the puncturing structure.

The present invention is further directed to a method of dispensing a dosage product within a carrier. The method includes providing a dosage dispensing cap and container assembly including a container defining an opening that leads to an interior space, a cap removably affixed over the opening, and a plunger slidably disposed within the channel. The cap defines a channel that leads to the interior space of the container and includes a puncturing structure positioned at a bottom region of the channel. The plunger includes a sleeve portion and a dosage product housed within the sleeve portion. The method further includes sliding the plunger within the channel from a first position in which the plunger is located in an upper region of the channel, to a second position in which the plunger is located in a lower region of the channel and the dosage product is in contact with the puncturing structure.

DETAILED DESCRIPTION OF THE PREFERRED EMBODIMENTS

Figure 1:
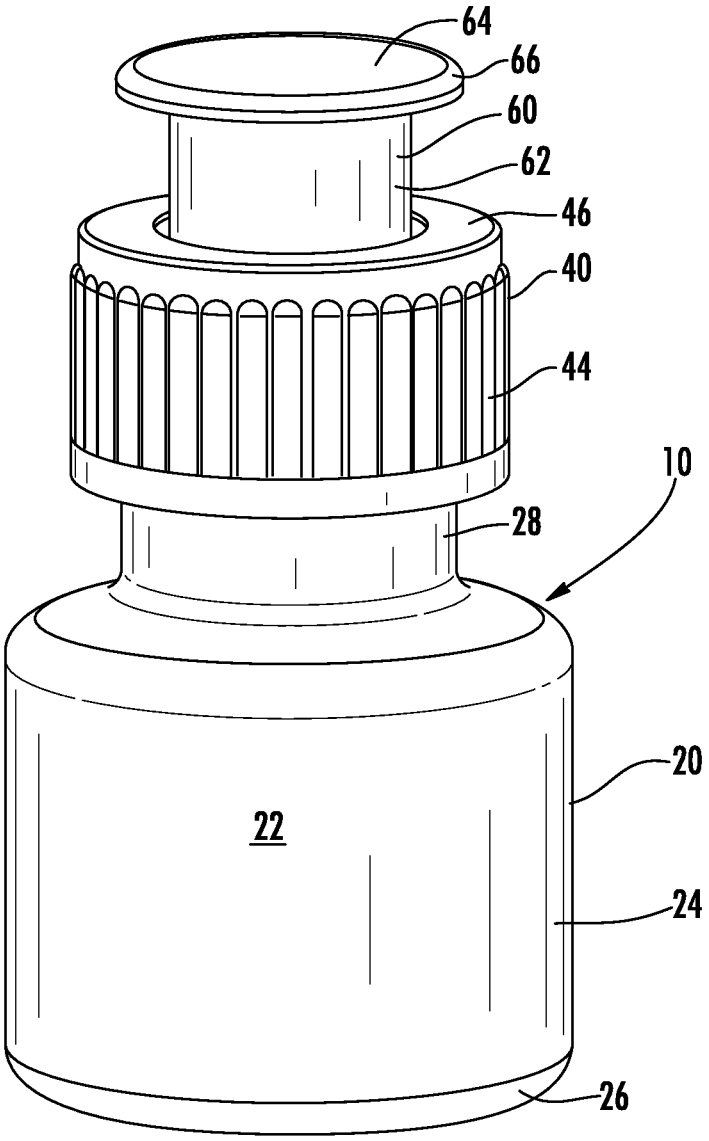
FIG. 1 shows a perspective view of a first embodiment of the dosage dispensing cap and container assembly.

Certain terminology is used in the foregoing description for convenience and is not intended to be limiting. Words such as "front," "back," "top," and "bottom" designate directions in the drawings to which reference is made. This terminology includes the words specifically noted above, derivatives thereof, and words of similar import. Additionally, the words "a" and "one" are defined as including one or more of the referenced item unless specifically noted. The phrase "at least one of" followed by a list of two or more items, such as "A, B or C," means any individual one of A, B or C, as well as any combination thereof.

Figure 2:
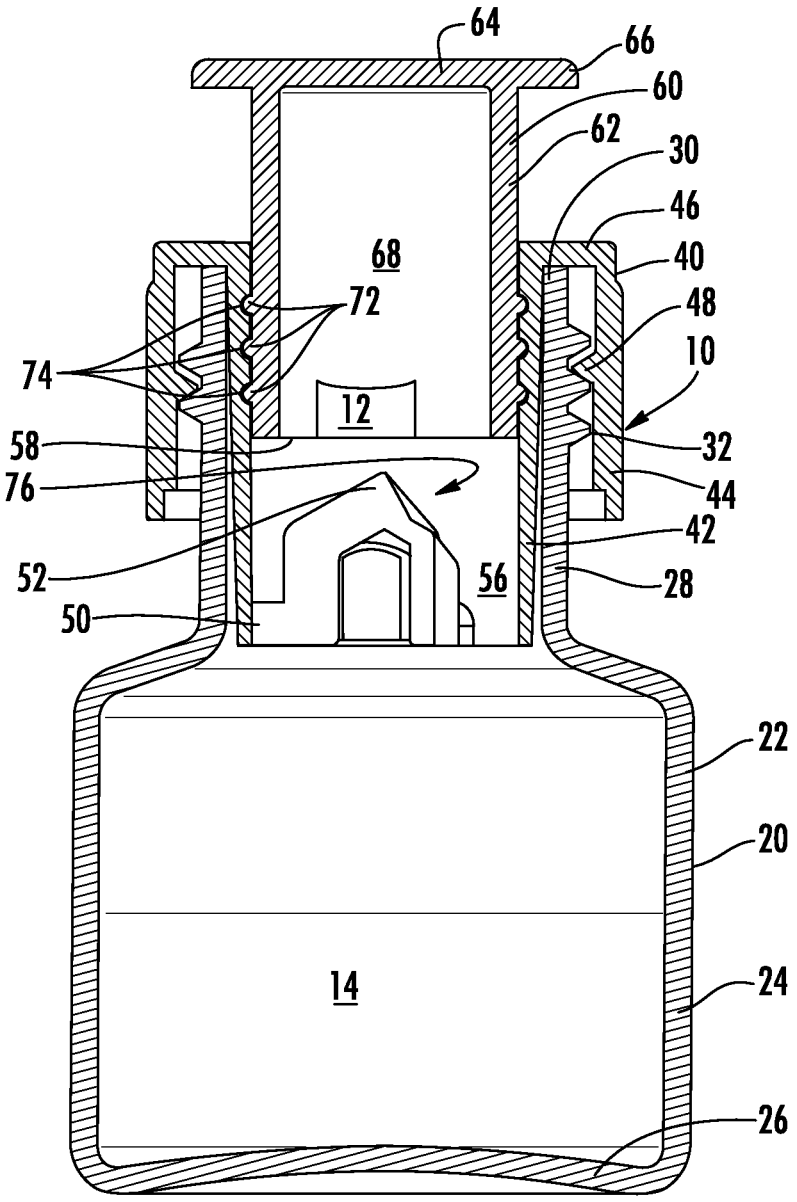
FIG. 2 shows a cross sectional view of the assembly of FIG. 1 in the starting position.
Figure 3:
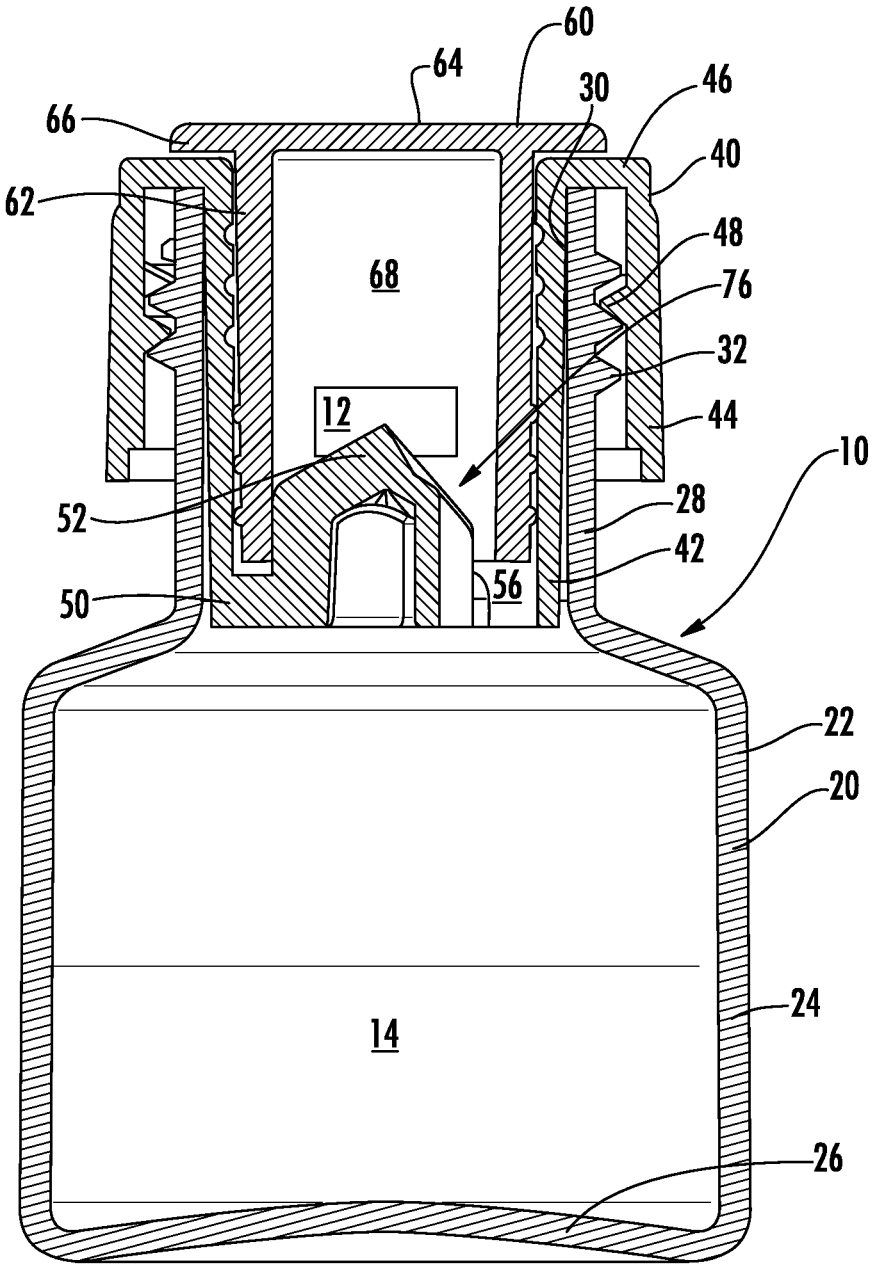
FIG. 3 shows a cross sectional view of the assembly of FIG. 1 in the dispensing position.

A first embodiment of a dosage dispensing cap and container assembly 10 is shown in FIGS. 1-3. The assembly includes a container 20, a cap 40, and a plunger 60. According to certain embodiments, the container 20, cap 40, and/or plunger 60, or any particular component thereof, may be injection molded from a polymeric material, such as a thermoplastic material, such as, for example, a polypropylene, such as a moisture blocking polymeric material. Additionally, an active agent, such as a desiccating agent, and channeling agent may be blended into the polymer to produce an active material. Examples of such active materials are disclosed in one or more of U.S. Pat. Nos. 6,130,263, 6,080,350, 6,221,446, 6,124,006, 6,214,255, 6,194,079, 6,316,520, 6,465,532, 5,911,937, 6,174,952, 6,177,183, 6,486,231, 6,696,002, 6,460,271, 6,613,405, 6,852,783, RE40,941, and 7,005,459, which are incorporated herein by reference as if fully set forth. Alternatively, according to other embodiments, the container 20, cap 40, and/or plunger 60 may contain a desiccant material, wherein the desiccant material is separately injection molded and assembled or formed in two shots in one injection mold.

The container 20 includes a housing portion 22 for housing a carrier 14 and configured for receiving a dispensed dosage product 12. The carrier 14 may be any type of liquid suitable for mixture with the dosage product 12. Examples of suitable carriers include consumable liquids such as water, juice, or milk. Other examples of suitable carriers include nonconsumable liquids such as solvents, as well as both consumable and nonconsumable solid materials such as powders and granules. The dosage product 12 can be any type of dosage product suitable for mixture with a carrier. Examples of suitable dosages 12 include consumable materials for mixture with consumable carriers, such as pharmaceutical products, supplements, and food products. Other examples of suitable dosages include nonconsumable materials for mixture with nonconsumable carriers, including colorants and fragrances. The dosage product 12 can be provided in any form that allows it to be mixed with the carrier, including solid forms such as powders, granules, puck, pill or tablet forms. The dosage product may also be provided in liquid form. Prior to dispensing, the dosage product 12 can optionally be housed in a rupturable package, such as a foil, paper or plastic package, or may be provided free of packaging.

In the illustrated embodiment, the housing portion 22 has a generally tubular body 24 with a base 26 portion for seating the container 20 on a surface. However, the container 20 may take on other shapes suitable for housing the carrier 14 and receiving the dosage product 12 as well, including, square, rectangular, trapezoidal, circular, and non-circular, among others.

A generally cylindrical neck 28 extends upward from the housing portion 22 and defines an opening 30. In the illustrated embodiment, the neck 28 has a smaller diameter than the cylindrical body 24 of the housing portion 22, but this is not required. The neck 28 is configured for attachment of the cap 40, as described in detail below.

Still referring to FIGS. 1-3, the cap 40 of the assembly 10 is shown. The cap 40 includes an inner tubular body 42 and an outer tubular body 44. When the cap 40 is affixed over the opening 30 of the container 20, the inner tubular body 42 is located within the neck 28 and the outer tubular body 44 is located outside of the neck 28. The inner tubular body 42 and the outer tubular body 44 are joined at their respective upper ends by a connecting wall 46, forming a substantially inverted U-shaped cross section, as shown in FIGS. 2 and 3. The connecting wall 46 sits on the upper end of the neck 28 in the configuration shown in FIGS. 2 and 3, though the connecting wall 46 need not actually contact the upper end of the neck 28.

The cap 40 can be affixed to the container 20 in a variety of ways. In the illustrated embodiment, the cap 40 and container 20 are affixed by a threaded connection. Outer threads 32 are defined on an outer surface of the neck 28 and engage inner threads 48 defined on an inner surface of the outer tubular body 44 of the cap 40. In alternative embodiments, other types of connections can be used to affix the cap 40 to the container 20, for example, other types of mechanical connections such as a snap fit or interference fit.

The cap 40 further includes an inner base portion 50 located at the bottom of the inner tubular body 42. As shown in FIG. 2, the inner base portion 50 sits within the container 20 when the cap 40 is affixed over the opening 30. The inner base portion 50 preferably sits above the carrier 14 located within the container 20 when the container 20 is in an upright position. The inner base portion 50 includes a puncturing structure 76 having a projection 52 that assists in dispensing the dosage product 12, as described in detail below. A lower channel 56 is defined between the projection 52 and a portion of the inner tubular body 42 for passage of the dosage product 12 during dispensing.

Figure 4:
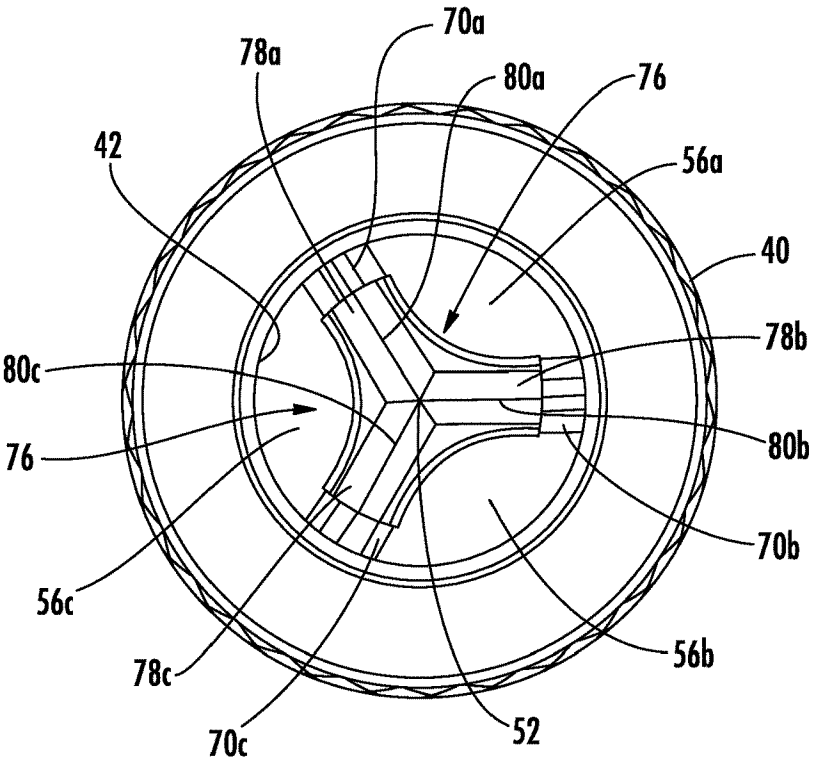
FIG. 4 shows a top view of an embodiment of a cap for the dosage dispensing cap and container assembly shown in FIG. 1.

As shown in FIG. 4, according to an embodiment, the inner base portion 50 includes at least one arm 70 that inwardly extends from the inner tubular body 42 and to the puncturing structure 76. For example, as shown in FIG. 4, according to certain embodiments, the inner base portion 50 includes three arms 70*a*, 70*b*, 70*c*. The arms 70*a*, 70*b*, 70*c* may be spaced apart from each other so as to provide one or more lower channels 56*a*, 56*b*, 56*c* for the dosage 12 to be dispensed to the carrier 14. Alternatively, the arms may include one or more orifices that form the lower channel 56 or other openings that allow for the passage of the dosage 12 through the inner base portion 50 and to the carrier 14. Additionally, at least a portion of the inner base portion 50 may be configured to direct dosage product 12 toward the lower channel 56. For example, the arms 70*a*, 70*b*, 70*c* may include one or more angled upper surfaces beneath at least a portion of the projection 52 that is/are angled to direct the dosage 12 toward the lower channel 56.

According to certain embodiments, the puncturing structure 76 may have puncturing arms 78*a*, 78*b*, 78*c*, that are extend toward the projection 52. Further, according to certain embodiments, the puncturing arms 78*a*, 78*b*, 78*c* may have angled upper walls that provide an apex 80*a*, 80*b*, 80*c* along the puncturing arms 78*a*, 78*b*, 78*c* that assist in the puncturing or breakage of the dosage product 12 or the packaging for the dosage product 12, and/or assist in directing the dosage product 12 toward the lower channels 56.

As shown in FIGS. 2 and 3, the plunger 60 includes a plunger tube 62 and an upper wall 64. The plunger tube 62 is slidably disposed within the inner tubular body 42 of the cap 40. The plunger 60 slides between a first or starting position, shown in FIG. 2, and a second or dispensing position, shown in FIG. 3. The upper wall 64 may extend beyond the plunger tube 62, as shown in the illustrated embodiment, so as to define a flange 66. As shown in FIG. 3, the flange 66 prevents the plunger 60 from sliding further downward than when in the dispensing position.

Figure 5:
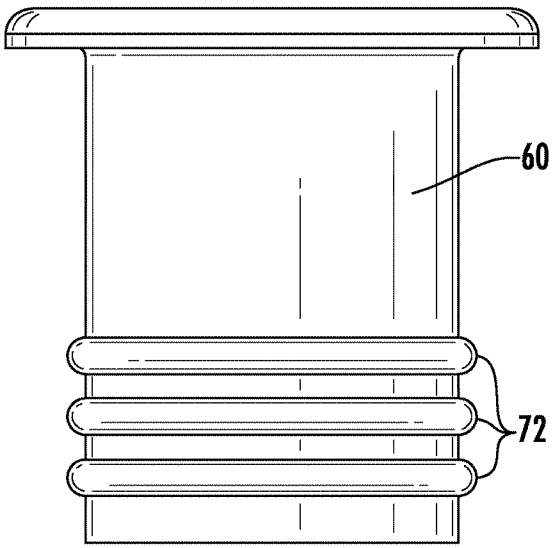
FIG. 5 shows a side view of an embodiment of a plunger for the dosage dispensing cap and container assembly shown in FIG. 1.

As shown in FIGS. 2 and 5, according to an embodiment, the plunger 60 may include at least one protrusion 72, such as a rib, flange, or thread, among others, that mate with a recess 74 in the inner tubular body 42 so as to prevent the inadvertent movement of the plunger 60 from the starting position. Moreover, the mating engagement of the protrusion 72 and recess 74 may prevent the plunger 60 from being moved from the starting position before the dosage product 12 is intended to be dispensed into the carrier 14. According to an embodiment, in use, a user may depress the plunger 60 with sufficient force to disengage the protrusion 72 from the recess 74, and allow the plunger 60 to be displaced from the starting position. According to another embodiment, the protrusion 72 and recess 74 may be mating external and internal threads, respectively, that require the user to, at least initially, turn of the plunger 60 relative to the inner wall member 60 to move the plunger 60 from the starting position. However, the plunger 60 may also be at least partially held or retained in the starting position through the use of other mechanisms, including, for example, a removable collar or tampering evident device positioned between a portion of the plunger 60 and the cap 40, such as the first tamper evidence device 170 discussed below, among others.

An interior space 68 that houses the dosage product 12 prior to dispensing is defined within the plunger tube 62. The interior space 68 is closed off at a top portion thereof by the upper wall 64 and optionally at a bottom portion by a lower frangible wall 58. The lower frangible wall 58 may be formed of any material that is easily ruptured by manual force, such as foil, paper or a thin sheet of plastic. In the illustrated embodiment, the lower frangible wall 58 supports the dosage product 12, but in embodiments where the lower frangible wall 58 is omitted, other structures could be provided for supporting the dosage product 12, such as a wall that extends within the plunger tube 62 for only a portion of the diameter thereof. Such structures should be sufficient in extent to support the dosage product 12, while still allowing the projection 52 to contact the dosage product 12 when the plunger 60 is depressed, as shown in FIG. 3.

The dosage product 12 is distributed within the carrier 14 by sliding the plunger 60 from the starting position shown in FIG. 2 to the dispensing position shown in FIG. 3. This causes the projection 52 to contact the dosage product 12. In embodiments where the lower frangible wall 58 is provided, it is ruptured by the projection 52 during sliding. In embodiments where the dosage product 12 is provided with a rupturable package, this package is ruptured by the projection during sliding. In embodiments where the dosage product is provided in the form of a pill or tablet, with our without the lower frangible wall 58 and the rupturable package, the dosage product 12 may be ruptured by the projection during sliding, however this is not required, and in other embodiments the pill or tablet may remain in-tact and be subsequently dissolved by the carrier 14.

Rupture of one or more of the dosage product 12, lower frangible wall 58, or packaging of the dosage product 12 by the projection 52 allows the dosage product 12 to exit the interior space 68 of the plunger tube 62. The dosage product 12 then passes downward through the lower channel(s) 56 of the cap 40 and into the housing portion 22 of the container for mixing with the carrier 14. The assembly 10 can optionally be shaken by a user to optimally distribute the dosage product 12 within the carrier 14. The cap 40 can then be removed from the container 20, by unscrewing in the illustrated example, allowing a user to access the mixture of dosage product 12 and carrier 14, or the mixture may flow out of the housing portion 22 through the lower channel(s) 56.

Figure 6:
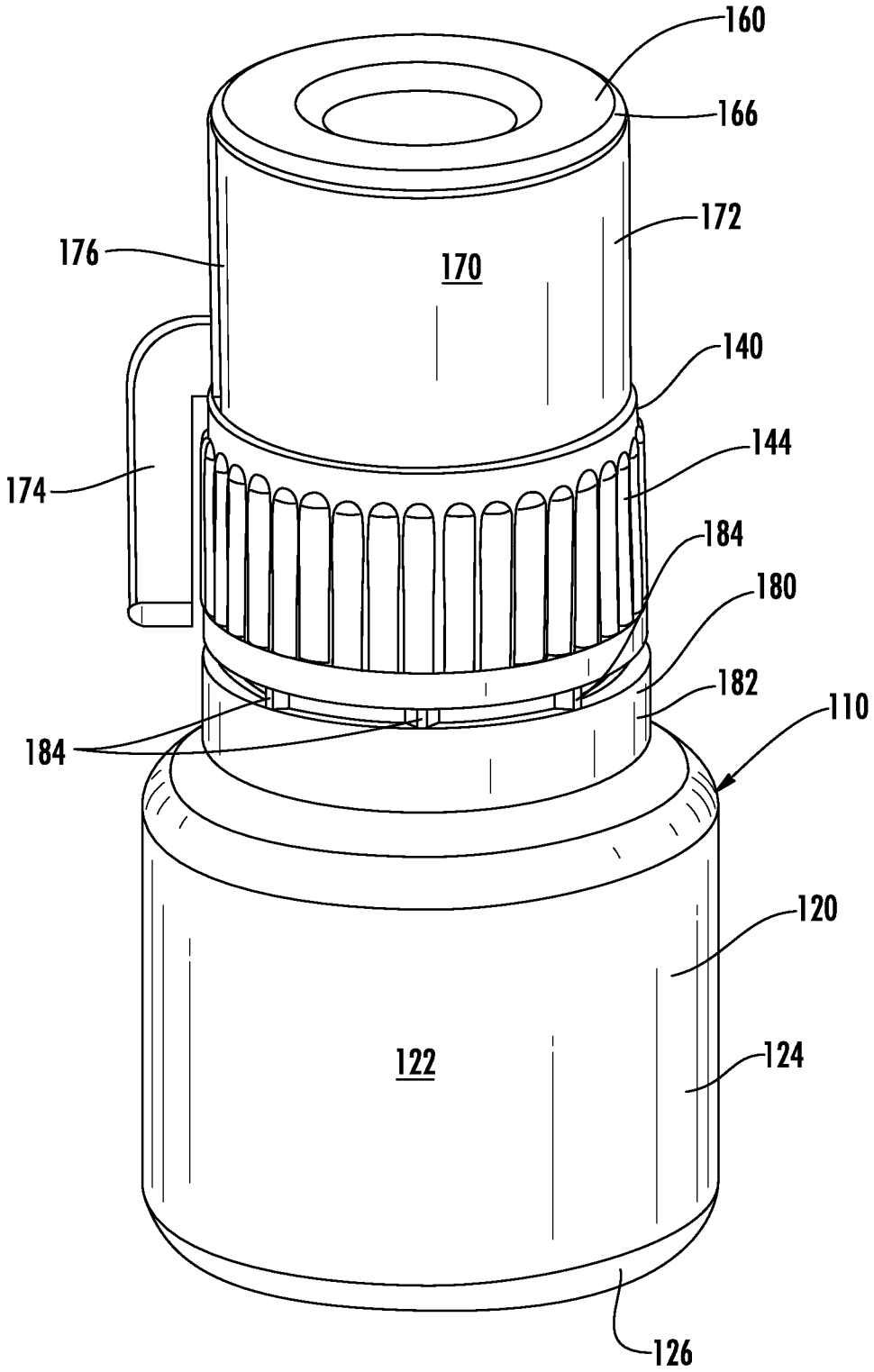
FIG. 6 shows a perspective view of a second embodiment of the dosage dispensing cap and container assembly having a tamper evident device.
Figure 7:
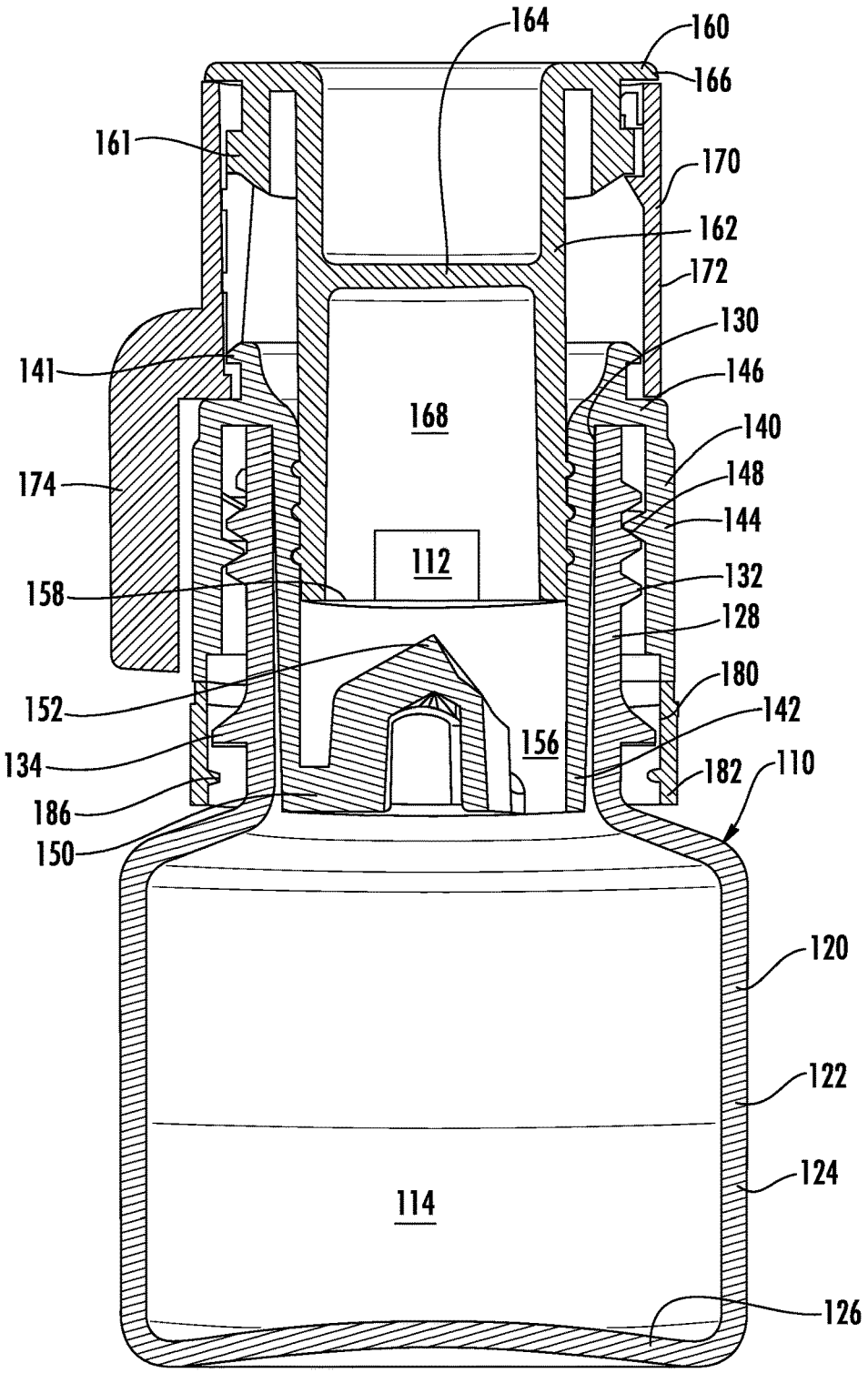
FIG. 7 shows a cross sectional view of the assembly of FIG. 6 in the starting position.
Figure 8:
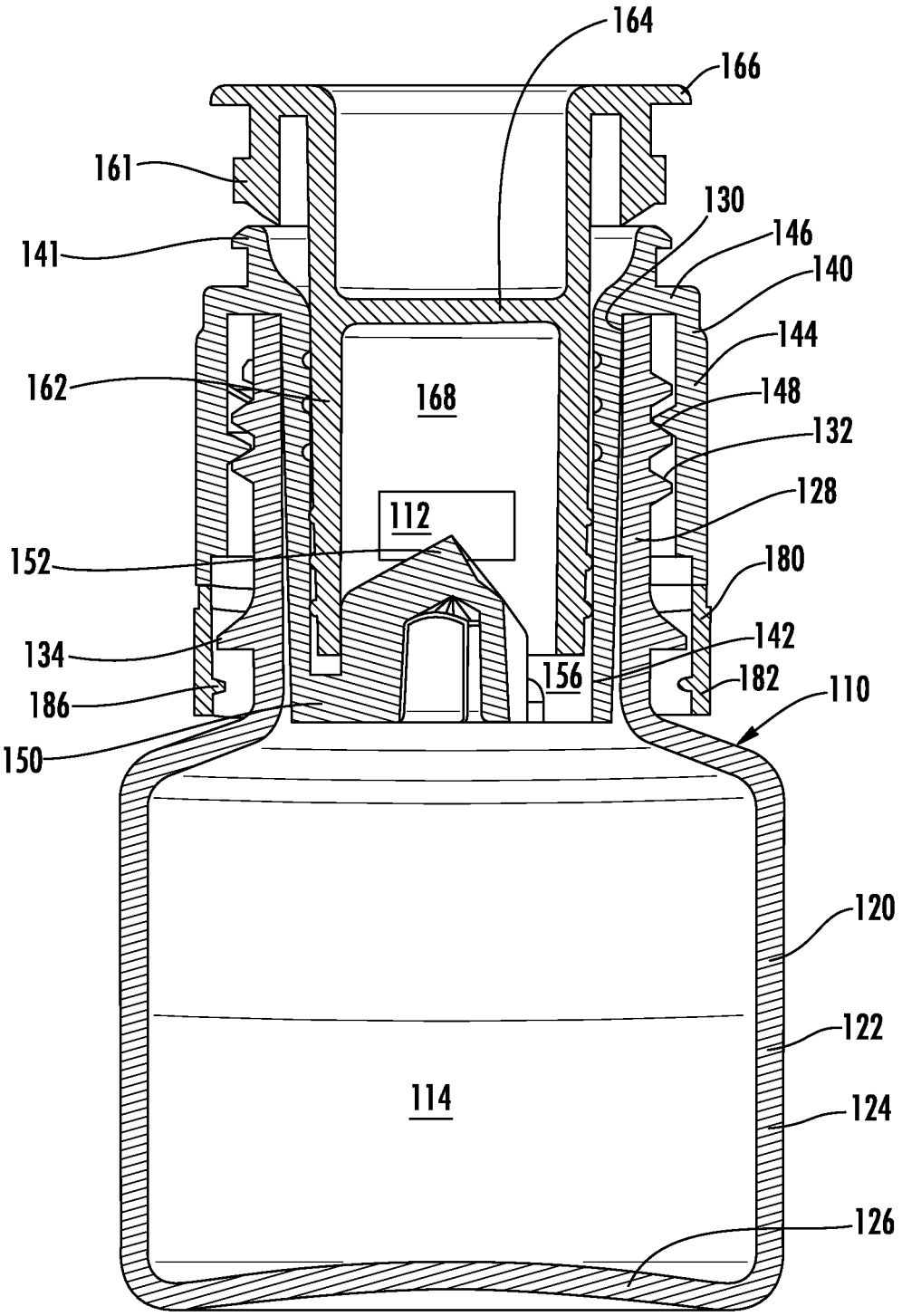
FIG. 8 shows a cross sectional view of the assembly of FIG. 7 in the dispensing position.

A second embodiment of a dosage dispensing cap and container assembly 110 is shown in FIGS. 6-8. The second embodiment of the assembly 110 includes many of the same features as the first embodiment, and such features should be considered the same or structurally equivalent unless otherwise described or shown in the drawings.

The second embodiment of the assembly differs from the first embodiment in that it includes a first tamper evident device 170. The first tamper evident device 170 includes a tubular sleeve 172 that extends between a portion of the plunger 160 and a portion of the cap 140 to prevent depression of the plunger 160. In the illustrated embodiment, the sleeve 172 extends between the flange 166 of the plunger 160 and the connecting wall 146 of the cap 140. The sleeve 172 is preferably dimensioned such that it cannot be removed from the assembly 110 without breakage. Alternatively, the sleeve 172 can be configured to allow for removal without breakage, but not for replacement on the assembly 110 once removed therefrom. In this respect, absence of the sleeve 172 on the assembly 110 indicates that the plunger 160 may have been previously depressed, and the dosage 112 distributed in the carrier 114.

The first tamper evident device 170 may optionally include removal structures including a pull tab 174 and perforations 176. When tension is applied to the pull tab 174, the sleeve 172 can be split along the perforations 176, permitting removal of the sleeve 172. Alternative types of removal structures may include devices that allow the sleeve 172 to be removed from the assembly 110 in-tact, but not replaced thereon.

The cap 140, plunger 160, or both, may optionally be provided with centering structures to retain the first tamper evident device 170 in a centered position on the assembly 110. In the illustrated embodiment the cap 140 and plunger 160 each include outwardly projecting collars 141, 161, having outer diameters slightly less than the inner diameter of the sleeve 172.

The second embodiment of the assembly 110 may further include a second tamper evident device 180. The second tamper evident device 180 includes a ring 182 attached to the cap 140 by a severable attachment mechanism. In the embodiment shown, the attachment mechanism includes a plurality of attachment tabs 184 that affix the ring 182 on the neck 128 of the container 120 at a position directly below the outer tubular body 144 of the cap 140.

The ring 182 is configured to remain in position on the neck 128, even when the cap 140 is removed. In the illustrated embodiment, this is achieved by way of a lower abutment 186 provided on the ring 182 that engages an upper abutment 134 provided on the neck 128. The lower abutment 186 extends inward from an inner surface of the ring 182, and the upper abutment extends outward from an outer surface of the neck 128. When the cap 140 is removed from the container 120, by rotating to disengage the threads 132, 148 in the embodiment shown, the cap 140 is moved in an upward direction on the neck 128, prior to being completely removed therefrom. The lower abutment 186 contacts the upper abutment 134, preventing the ring 182 from moving upwards and being removed from the neck 128, and causing breakage of the attachment tabs 182. Broken attachment tabs 182 thus indicate that the cap 140 has previously been removed from the assembly 110, and that possible tampering has occurred, such as addition to or removal from the contents of the container 120.

A third optional feature of the assembly shown in the embodiment of FIGS. 7-8 is a recessed upper wall 164 of the plunger 160. In this embodiment the upper wall 164 and the flange 166 are separated, and instead of being positioned at an upper end of the plunger tube 162, the upper wall 164 extends within the plunger tube 162 at a location below the upper end thereof. This permits the dosage 112 to be dispensed with a smaller downward depression of the plunger 160, as the upper wall 164 forces the dosage 112 to come into contact with the projection 152.

Further embodiments of the assembly could include only one of or any combination of the first or second tamper evident devices 170, 180 or the lowered upper wall 164 of the plunger.

While the preferred embodiments of the invention have been described in detail above, the invention is not limited to the specific embodiments described, which should be considered as merely exemplary.

REFERENCE NUMBER LIST

| | |
|---|---|
| 10 | Cap and Container Assembly |
| 12 | Dosage |
| 14 | Carrier |

-continued

| | |
|---|---|
| 20 | Container |
| 22 | Housing Portion |
| 24 | Body |
| 26 | Base |
| 28 | Neck |
| 30 | Opening |
| 32 | Outer Threads |
| 40 | Cap |
| 42 | Inner Tubular Body |
| 44 | Outer Tubular Body |
| 46 | Connecting Wall |
| 48 | Inner Threads |
| 50 | Inner Base Portion |
| 52 | Projection |
| 56 | Lower Channel |
| 58 | Lower Frangible Wall |
| 60 | Plunger |
| 62 | Plunger Tube |
| 64 | Upper Wall |
| 66 | Flange |
| 68 | Interior Space |
| 70 | Arm |
| 72 | Protrusion |
| 74 | Recess |
| 76 | Puncturing structure |
| 78 | Puncturing arms |
| 80 | Apex |
| 110 | Cap and Container Assembly |
| 112 | Dosage |
| 114 | Carrier |
| 120 | Container |
| 122 | Housing Portion |
| 124 | Body |
| 126 | Base |
| 128 | Neck |
| 130 | Opening |
| 132 | Outer Threads |
| 134 | Upper Abutment |
| 140 | Cap |
| 141 | Collar |
| 142 | Inner Tubular Body |
| 144 | Outer Tubular Body |
| 146 | Connecting Wall |
| 148 | Inner Threads |
| 150 | Inner Base Portion |
| 152 | Projection |
| 156 | Lower Channel |
| 158 | Lower Frangible Wall |
| 160 | Plunger |
| 161 | Collar |
| 162 | Plunger Tube |
| 164 | Upper Wall |
| 166 | Flange |
| 168 | Interior Space |
| 170 | First Tamper Evident Device |
| 172 | Sleeve |
| 174 | Pull Tab |
| 176 | Perforations |
| 180 | Second Tamper Evident Device |
| 182 | Ring |
| 184 | Attachment Tabs |
| 186 | Lower Abutment |

What is claimed is:

1. A method of making a dosage dispensing assembly, the method comprising:

providing (i) a dosage product, (ii) a container defining an opening that leads to an interior space, (iii) a dosage dispensing cap formed of a polymeric material and configured for dispensing the dosage product into the container, the cap being releasably secured over the opening, the cap defining a channel that leads to the interior space, (iv) a plunger formed of a polymeric material disposed within the channel and axially displaceable therein, the plunger including a sleeve portion having a storage portion holding the dosage product therein for rupturable release into the interior space, the plunger being configured to axially displace downwardly within the channel between a first position in which the plunger is located in an upper region of the channel, and a second position in which the plunger is located in a lower region of the channel, whereupon a puncturing structure of the assembly engages the storage portion to rupturably release the dosage product from the storage portion and dispense the dosage product into the container, (v) a desiccant entrained polymer material and injection molding it to or assembling it with the polymeric material of the plunger, and (vi) a tamper evident device attached to the cap;

disposing the dosage product within the storage portion of the plunger and closing off the dosage product therein with a rupturable wall provided at a bottom of the storage portion, wherein the dosage product is solid;

filling the interior space of the container with a liquid carrier; and releasably securing the cap over the opening such that the tamper evident device is at least partially removed or ruptured prior to the plunger being permitted to move from the first position to the second position.

2. The method of claim 1, wherein the dosage product comprises a pharmaceutical or supplement.

3. The method of claim 1, wherein the desiccant is separately injection molded and assembled.

4. The method of claim 1, wherein the desiccant is formed in two shots in one injection mold.

5. The method of claim 1, wherein the plunger is configured to slide between the first position and the second position.

6. The method of claim 1, wherein the tamper evident device includes a pull tab and perforations, and wherein when tension is applied to the pull tab, a portion of the pull tab is configured to be slit along the perforations.

7. A method of making a dosage dispensing assembly, the method comprising:

providing (i) a dosage product, (ii) a container defining an opening that leads to an interior space, (iii) a dosage dispensing cap formed of a polymeric material and configured for dispensing the dosage product into the container, the cap being releasably secured over the opening, the cap defining a channel that leads to the interior space, (iv) a plunger formed of a polymeric material disposed within the channel and axially displaceable therein, the plunger including a sleeve portion having a storage portion holding the dosage product therein for rupturable release into the interior space, the plunger being configured to axially displace downwardly within the channel between a first position in which the plunger is located in an upper region of the channel, and a second position in which the plunger is located in a lower region of the channel, whereupon a puncturing structure of the assembly engages the storage portion to rupturably release the dosage product from the storage portion and dispense the dosage product into the container, (v) a desiccant entrained polymer material and injection molding it to or assembling it with the polymeric material of the plunger, (vi) a first tamper evident device attached to the cap, and (vii) a second tamper evident device attached to the cap;

disposing the dosage product within the storage portion of the plunger and closing off the dosage product therein with a rupturable wall provided at a bottom of the storage portion, wherein the dosage product is solid;

filling the interior space of the container with a liquid carrier; and releasably securing the cap over the opening such that each tamper evident device is at least partially removed prior to the plunger being permitted to move from the first position to the second position.

8. The method of claim 7, wherein the dosage product comprises a pharmaceutical or supplement.

9. The method of claim 7, wherein the desiccant is separately injection molded and assembled.

10. The method of claim 7, wherein the desiccant is formed in two shots in one injection mold.

11. The method of claim 7, wherein the plunger is configured to slide between the first position and the second position.

12. The method of claim 7, wherein the first tamper evident device includes a pull tab and perforations, and wherein when tension is applied to the pull tab, a portion of the pull tab is configured to be slit along the perforations.

* * * * *